US009708771B2

(12) United States Patent
Haufe et al.

(10) Patent No.: US 9,708,771 B2
(45) Date of Patent: Jul. 18, 2017

(54) AQUEOUS EMULSION OF A SIZING AGENT

(71) Applicant: BASF SE, Ludwigshafen (DE)

(72) Inventors: Ingrid Haufe, Dresden (DE); Klaus Möller, Mutterstadt (DE); Attila Kurucz, Graz (AT)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 14/771,868

(22) PCT Filed: Feb. 24, 2014

(86) PCT No.: PCT/IB2014/059202
§ 371 (c)(1),
(2) Date: Sep. 1, 2015

(87) PCT Pub. No.: WO2014/132175
PCT Pub. Date: Sep. 4, 2014

(65) Prior Publication Data

US 2016/0010282 A1 Jan. 14, 2016

Related U.S. Application Data

(60) Provisional application No. 61/771,099, filed on Mar. 1, 2013.

(30) Foreign Application Priority Data

Mar. 1, 2013 (EP) ..... 13157373

(51) Int. Cl.

| | |
|---|---|
| ***D21H 21/16*** | (2006.01) |
| ***D21H 17/34*** | (2006.01) |
| ***D21H 17/15*** | (2006.01) |
| ***D21H 17/00*** | (2006.01) |
| ***D21H 17/07*** | (2006.01) |
| ***D21H 17/16*** | (2006.01) |
| ***D21H 17/17*** | (2006.01) |
| ***D21H 17/37*** | (2006.01) |
| ***D21H 17/55*** | (2006.01) |
| ***D21H 17/56*** | (2006.01) |

(52) U.S. Cl.
CPC ..... *D21H 21/16* (2013.01); *D21H 17/07* (2013.01); *D21H 17/15* (2013.01); *D21H 17/16* (2013.01); *D21H 17/17* (2013.01); *D21H 17/34* (2013.01); *D21H 17/37* (2013.01); *D21H 17/55* (2013.01); *D21H 17/56* (2013.01); *D21H 17/72* (2013.01)

(58) Field of Classification Search
CPC ..... D21H 17/07; D21H 17/15; D21H 17/34; D21H 17/72; D21H 21/16; D21H 17/16; D21H 17/17; D21H 17/37; D21H 17/55; D21H 17/56
USPC ..... 524/112
See application file for complete search history.

(56) References Cited

U.S. PATENT DOCUMENTS

| | | | | |
|---|---|---|---|---|
| 5,397,436 | A | 3/1995 | Robeson et al. | |
| 6,576,086 | B1 | 6/2003 | Ettl et al. | |
| 2006/0037512 | A1 | 2/2006 | Pawlowska et al. | |
| 2006/0162883 | A1 | 7/2006 | Champ et al. | |
| 2007/0167558 | A1 | 7/2007 | Bonn et al. | |
| 2008/0041546 | A1* | 2/2008 | Schmid | D21H 21/16 162/164.6 |
| 2010/0016478 | A1 | 1/2010 | Brockmeyer et al. | |
| 2011/0146926 | A1 | 6/2011 | Ehrhardt et al. | |
| 2015/0020988 | A1* | 1/2015 | St. John | |

FOREIGN PATENT DOCUMENTS

| | | | |
|---|---|---|---|
| CN | 101068986 | A | 11/2007 |
| DE | 10 2011 101232 | | 11/2011 |
| GB | 2268758 | A | 1/1994 |
| JO | H06200497 | A | 7/1994 |
| JP | H07319109 | A | 12/1995 |
| JP | 2005-535798 | A | 11/2005 |
| JP | 2006-510823 | A | 3/2006 |
| JP | 2007-525607 | A | 9/2007 |
| JP | 2010-513734 | A | 4/2010 |
| WO | 97/05330 | | 2/1997 |
| WO | 98/50630 | | 11/1998 |
| WO | 03/106767 | | 12/2003 |
| WO | 2004/022847 | | 3/2004 |
| WO | 2004/059082 | | 7/2004 |
| WO | WO-2011/075633 | A2 | 6/2011 |

OTHER PUBLICATIONS

English language machine-generated translation for DE10 2011 101232 (7 pages); 2011.
Supplementary European Search Report for Patent Application No. EP 14 75 7478, dated Sep. 8, 2016.

* cited by examiner

*Primary Examiner* — Ling Choi
*Assistant Examiner* — Chun-Cheng Wang
(74) *Attorney, Agent, or Firm* — Marshall, Gerstein & Borun LLP

(57) ABSTRACT

A method of preparing an aqueous emulsion of a sizing agent for use in a papermaking process comprising, emulsifying the sizing agent into an aqueous liquid, in which an aqueous dispersion of a water-soluble polymer of N-vinylformamide and/or N-vinylacetamide units is added to either the sizing agent or the aqueous liquid before, during or after emulsification, wherein the dispersion contains, based on 100 parts by weight of water, (A) from 0.1 to 80 parts by weight of a water-soluble polymer containing N-vinylformamide units and/or N-vinylacetamide units, and (B) from 0.02 to 50 parts by weight of at least one polymeric dispersant.

8 Claims, 1 Drawing Sheet

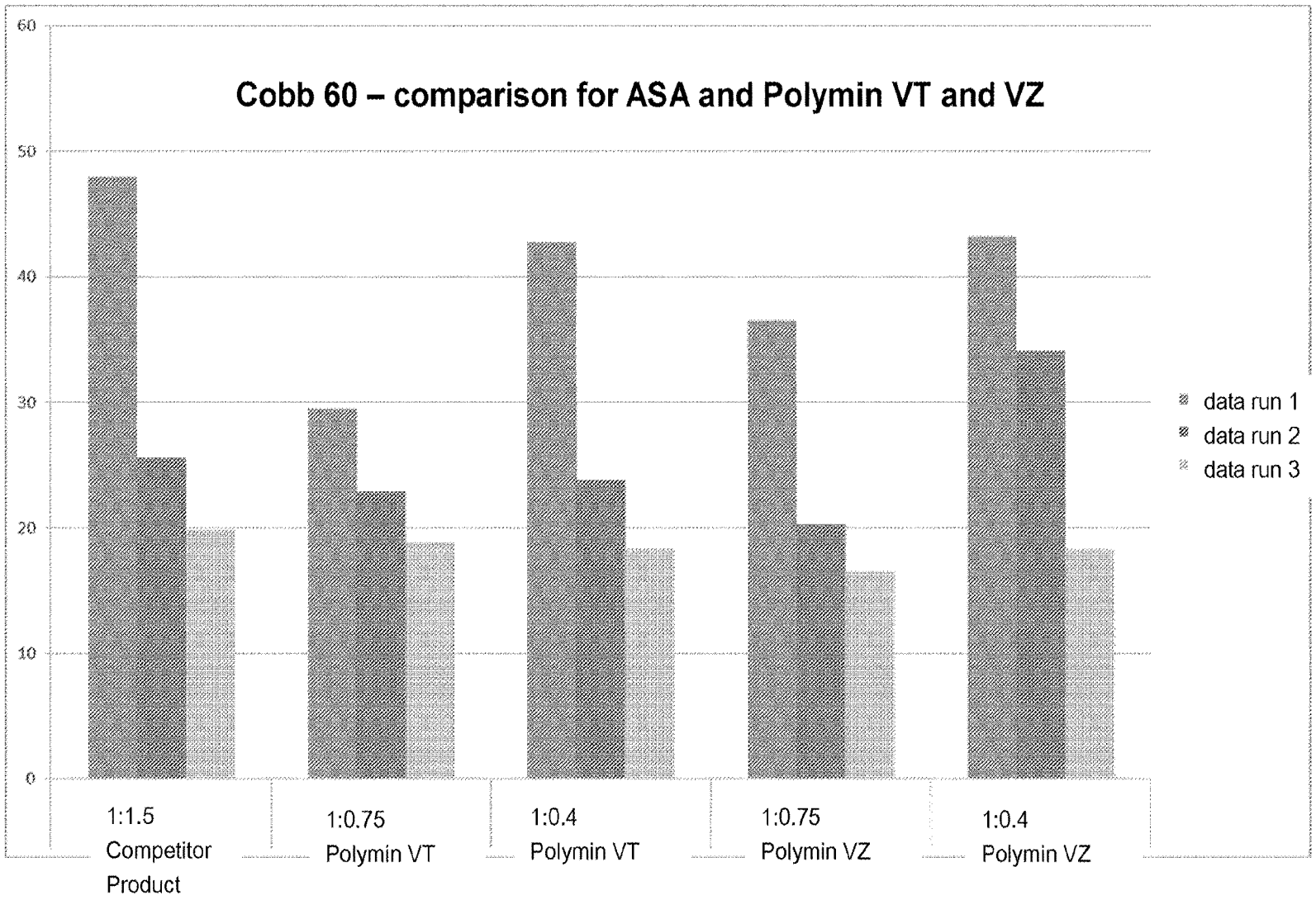
Cobb 60 – comparison for ASA and Polymin VT and VZ
data run 1
data run 2
data run 3
60
50
40
30
20
10
0
1:1.5 Competitor Product
1:0.75 Polymin VT
1:0.4 Polymin VT
1:0.75 Polymin VZ
1:0.4 Polymin VZ

AQUEOUS EMULSION OF A SIZING AGENT

CROSS-REFERENCE TO RELATED APPLICATIONS

This application is a National Stage Entry of International Application PCT/IB2014/059202 filed Feb. 24, 2014, which claims the benefit of U.S. Provisional Application No. 61/771,099, filed Mar. 1, 2013 and claims priority of EP 13157373.5 filed Mar. 1, 2013, wherein the contents of all applications are herein incorporated by reference.

FIELD OF THE INVENTION

The present invention relates to a method of preparing aqueous emulsions sizing agent useful in papermaking processes. The method employs an aqueous dispersion of a water-soluble polymer of N-vinylformamide and/or N-vinylacetamide units. The present invention furthermore relates to aqueous emulsions of sizing agent obtainable by said method. Additionally, the present invention relates to the use of an aqueous dispersion of a water-soluble polymer of N-vinylformamide and/or N-vinylacetamide units for preparing aqueous emulsions of sizing agent.

BACKGROUND OF THE INVENTION

Sizing is used during a manufacture to impart a degree of hydrophobicity to the paper in order to reduce the tendency for dry paper to absorb aqueous liquid. It is common practice to employ sizing agents, such as alkenyl succinic anhydrides, during paper manufacturing in order to obtain sized paper. Sizing agents are hydrophobic substances and are therefore generally added as aqueous emulsions. Such aqueous emulsions of sizing agents may be employed for engine sizing (often termed internal sizing) or surface sizing.

It is common practice to stabilise aqueous emulsions of sizing agents, such as alkenyl succinic anhydrides, with cationic starch or with anionic emulsifiers. Generally cationic starch functions as a protective colloid to help prevent destabilisation of the dispersed phase sizing agent in the emulsion.

WO 2004/022847 discloses the use of polymers comprising vinylamine units as promoters for the engine sizing of paper. For example, aqueous dispersions which comprise stearyldiketene, cationic starch and polyvinylamine are described therein.

WO 2004/059082 relates to an aqueous sizing composition comprising (a) an emulsion that contains an alkenyl succinic anhydride component suspended in an aqueous polymer solution, and (b) a second component selected from the group consisting of cationic starches, anionic starches, water-soluble polymers, water, and mixtures thereof, wherein the alkenyl succinic anhydride component is sufficiently dilute to enable the sizing composition to impart useful sizing properties to a fibrous substrate.

WO 98/50630 describes a process for the production of paper, board and cardboard involving draining a paper stock containing interfering substances in the presence of a fixing agent which is a reaction product prepared by reacting and amino- or ammonium-containing polymer selected from the group consisting of a polymer containing vinyl amine units, a polyalkylene polyamine, a polyamido amine, a polydiallyl dimethyl ammonium chloride, a polymer containing dialkyl amino alkyl acrylamide units or dialkyl amino methacrylamide units, a polyallylamine, and a dicyandiamide-formaldehyde-condensate, with a reactive sizing agent for paper in a weight ratio of polymer to reactive sizing agent in the range of from 15,000:1 to 1:5.

WO 97/05330 reveals a method in papermaking for improving the sizing efficiency of alkenyl succinic anhydride which comprises adding thereto a synthetic cationic polymer that is reactive with said anhydride. In a preferred embodiment, the cationic polymer is a copolymer of about 50 to about 99 mol % vinyl alcohol and about 50 to about 1 mol % vinyl amine. According to another preferred embodiment, the cationic polymer is a copolymer of about 20 to about 90 mol % acrylamide and about 80 to about 10 mol % vinyl amine.

WO 03/106767 defines an aqueous sizing composition which comprises an aqueous emulsion of ASA in which the ASA incorporates a maximum of 1% by weight of polymeric residues. It is indicated that the ASA distillate maybe emulsified in water together with a starch stabiliser. Examples of suitable stabilisers indicated include cationic and anionic starch, a cationic polyacrylamide or other cationic polymer.

DE 10 2011 101232 is directed to a process of emulsifying sizing agents for paper manufacturing in which the sizing agent is emulsified together with a polymer comprising vinyl amine monomers.

However, it is often difficult to form a stable emulsion of sizing agents, particularly of alkenyl succinic anhydrides. Even with cationic polymers, including conventional polymers of vinyl amine polymers, it is often difficult to consistently and reliably form stable aqueous emulsions of sizing agents, including alkenyl succinic anhydrides.

The inventors of the present invention have discovered that improvements in stability can be achieved when certain aqueous dispersions of water-soluble polymers of N-vinylformamide and/or N-vinylacetamide units are applied before during or after emulsification of the sizing agent into an aqueous liquid.

SUMMARY OF THE INVENTION

The present invention relates to a method of preparing an aqueous emulsion of a sizing agent for use in a paper, board or cardboard making process comprising, emulsifying the sizing agent into an aqueous liquid, in which an aqueous dispersion of a water-soluble polymer of N-vinylformamide and/or N-vinylacetamide units is added to either the sizing agent or the aqueous liquid before, during or after emulsification, wherein the dispersion contains, based on 100 parts by weight of water, (A) from 0.1, preferably from 3.0, to 80 parts by weight of a water-soluble polymer containing N-vinylformamide units and/or N-vinylacetamide units, and (B) from 0.02, preferably from 0.6, to 50 parts by weight of at least one polymeric dispersant.

The invention also relates to the aqueous emulsion of a sizing agent for use in a paper, board or cardboard making process obtainable by the above-mentioned method.

The invention additionally relates to the use of an aqueous dispersion of a water-soluble polymer of N-vinylformamide and/or N-vinylacetamide units for the preparation of an aqueous emulsion of a sizing agent, wherein the dispersion contains, based on 100 parts by weight of water, (A) from 0.1, preferably from 3.0, to 80 parts by weight of a water-soluble polymer containing N-vinylformamide units and/or N-vinylacetamide units, and (B) from 0.02, preferably from 0.6, to 50 parts by weight of at least one polymeric dispersant.

The sizing agent may be any suitable sizing agent. Although sizes such as rosin may be employed, desirably the sizing agent is a reactive sizing agent. By reacting sizing agent we mean that the sizing agent is reactive with cellulose.

Suitable reactive sizes for the novel method of preparing sizing emulsions are, for example, $C_{12}$- to $C_{22}$-alkylketene dimers, $C_6$- to $C_{30}$-alkyl- or $C_6$- to $C_{30}$-alkenylsuccinic anhydrides, $C_{12}$- to $C_{36}$-alkyl isocyanates and/or organic isocyanates, such as dodecyl isocyanate, octadecyl isocyanate, tetradecyl isocyanate, hexadecyl isocyanate, eicosyl isocyanate and decyl isocyanate. Preferably used engine sizes are alkylketene dimers and long-chain alkyl- or alkenylsuccinic anhydrides.

Examples of alkylketene dimers are tetradecyldiketene, stearyldiketene, lauryldiketene, palmityldiketene, oleyldiketene, behenyldiketene or mixtures thereof. Alkyldiketenes having different alkyl groups, such as stearylpalmityldiketene, behenylstearyldiketene, behenyloleyldiketene or palmitylbehenyldiketene, are also suitable.

Preferred sizing agents are alkyl succinic anhydrides and alkenyl succinic anhydrides.

Alkenylsuccinic anhydrides are described in detail, for example, in U.S. Pat. No. 3,102,064, EP-A 0 609 879 and EP-A 0 593 075. All alkenylsuccinic anhydrides which have been described to date in the literature as sizes for paper are suitable according to the invention as active substance, either alone or in combination with alkyldiketenes. Suitable alkylsuccinic anhydrides comprise an alkyl radical having at least 6 carbon atoms, preferably a $C_{14}$- to $C_{24}$-olefin radical, in the alkyl group. Particularly preferred alkenylsuccinic anhydrides comprise 16 to 22, in general 16 to 18, carbon atoms in the alkenyl group. They may comprise linear, additionally unsaturated or branched alkenyl groups. Alkenylsuccinic anhydrides are obtainable, for example, from α-olefins, which are first isomerized. A mixture of different isomers is obtained, which is then reacted with maleic anhydride by an ene reaction to give succinic anhydrides. Alkenyl succinic anhydrides are prepared according to EP-A 0 593 075 by reaction of propylene or n-butylene oligomers with maleic anhydride. Examples of this group of reactive sizes are decenylsuccinic anhydride, dodecenylsuccinic anhydride, octenylsuccinic anhydride and n-hexadecenylsuccinic anhydride. The individual isomeric succinic anhydride may have different sizing effects. Thus, for example, 2- and 3-hexadecenyl-succinic anhydrides are not as effective as engine sizes as the isomeric 4-, 5-, 6-, 7- and 8-hexadecenylsuccinic anhydrides.

Usually, the aqueous emulsions of sizing agent contain from 1 to 50% by weight, based on the total weight of the emulsion, of sizing agents. For example, the emulsions have a content of from 1 to 50, preferably from 5 to 35, % by weight, based on the total weight of the emulsion, of $C_{12}$- to $C_{22}$-alkyldiketenes. With the use of $C_6$- to $C_{30}$-alkyl- or $C_6$- to $C_{30}$-alkenylsuccinic anhydrides, the content thereof is, for example, from 1 to 25, such as from 1 to 20% by weight based on the total weight of the emulsion for instance 1 to 10%, preferably 1 to 5%, typically 2 to 3% by weight based on total weight of emulsion.

In some cases, the sizing agent may contain additional compounds, for instance starch or cationic starch. Often alkyl succinic anhydride or alkenyl succinic anhydride sizing agents contain starch or cationic starch. Usually when the sizing agent is emulsified into the aqueous liquid the starch or cationic starch would dissolve in the aqueous liquid. Typically such sizing agent emulsions would contain starch or cationic starch in an amount of less than 10% and often between 2 and 4% by weight of total sizing agent emulsion.

BRIEF DESCRIPTION OF THE DRAWING

The FIGURE shows a chart, which compares the Cobb 60 values for Alkenyl Succinic Anhydride (ASA) emulsions prepared with different polymers.

DETAILED DESCRIPTION OF THE INVENTION

Aqueous emulsions of sizing agents for the purposes of the present invention are all two-phase and multiphase systems such as dispersions and emulsions in which the sizing agent is in a dispersed phase within an aqueous continuous phase.

Emulsification of the sizing agent can be achieved using conventional equipment and procedures typically used for producing aqueous emulsions of sizing agents. The aqueous dispersion of a water-soluble polymer of N-vinylformamide and/or N-vinylacetamide units can be diluted by the addition of water to a concentration of between 0.75 and 3%, based on dry polymer. The pH of this diluted polymer can desirably be between 3 and 7. The diluted polymer may be added with the sizing agent, either separately or together, to the emulsification equipment. Numerous systems for emulsifying liquids to form an emulsion are known in the literature. Examples include static mixers, rotor-stator devices, high-pressure homogenisers, ultrasound homogenisers, screen or mesh emulsification techniques, and membrane emulsification techniques. Particularly suitable emulsification equipment for making sizing agent emulsions includes a Cavitron or a modified Cavitron. Such systems may employ recirculation of the mixture of diluted polymer and sizing agent. Such equipment may employ a pressure between 5 and 15 bar. A typical energy consumption may be below 30 kW/hour. The final sizing emulsions employed at a paper machine may have a particle size of up to 1 μm, for instance between 0.5 and 1 μm.

According to the inventors the aqueous dispersion of a water-soluble polymer of N-vinylformamide and/or N-vinylacetamide units is added to either the sizing agent or the aqueous liquid before, during or after emulsification. Preferably this aqueous dispersion of the water-soluble polymer should be present during the emulsification of the sizing agent into the aqueous liquid. This may be achieved by combining said aqueous dispersion with the mixture of sizing agent and aqueous liquid during the emulsification step. It may be desirable to combine the aqueous dispersion with the sizing agent before addition to the aqueous liquid (i.e. into which the sizing agent is emulsified. More preferably the aqueous dispersion of the water-soluble polymer should be combined with the aqueous liquid prior to the addition of the sizing agent.

The dose of the aqueous dispersion of water-soluble polymer of N-vinylformamide and/or N-vinylacetamide units suitably may be between 5% and 100% by weight based on the weight of the sizing agent. Preferably the dose should be between 10% and 95% and more preferably between 20% and 90%, still more preferably between 30% and 85%, particularly between 35% and 80%.

The amount of polymer (A) may be determined as between 1% and 45% by weight calculated on the weight of the sizing agent. Often the amount of polymer (A) may be between 3% and 40%, usually between 7% and 35%, preferably between 10% and 30%.

It is believed that the aqueous dispersion of water-soluble polymer of N-vinylformamide and/or N-vinylacetamide units is functioning as a protective colloid. It is considered that the addition of this aqueous dispersion of polymer helps stabilise the droplets of sizing agent against coalescence.

The aqueous emulsions of sizing agent prepared by the method of the present invention have improved stability by comparison to aqueous sizing agent emulsions prepared using other cationic polymers. The dispersed phase of sizing agent may have particle sizes between 0.5 and 10 μm, often between 0.5 and 7 μm. Suitably the dispersed phase of sizing agent may be at least 90% below 6 μm and may be at least 50% below 3 μm. Preferably the dispersed phase may be at least 90% below 2 μm and at least 50% below 1 μm. The aqueous emulsions of sizing agent exhibit improved storage stability.

The aqueous dispersion of water-soluble polymer of N-vinylformamide and/or N-vinylacetamide units preferably contains, based on 100 parts by weight of water, (A) from 5 to 80 parts by weight of a water-soluble polymer containing N-vinylformamide units and/or N-vinylacetamide units and (B) from 1 to 50 parts by weight of the at least one polymeric dispersant.

The aqueous dispersion of water-soluble polymer of N-vinylformamide and/or N-vinylacetamide units more preferably contains, based on 100 parts by weight of water, (A) from 10 to 50 parts by weight of a water-soluble polymer containing N-vinylformamide units and/or N-vinylacetamide units and (B) from 5 to 40 parts by weight of the at least one polymeric dispersant.

Particularly preferred dispersions are those which contain as component (A) a homopolymer of N-vinylformamide.

N-vinylformamide units and/or N-vinylacetamide units can be illustrated with the aid of the following formula:

(I)

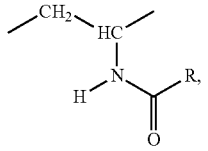

where R is H or $CH_3$

The water-soluble polymers containing N-vinylformamide units and/or N-vinylacetamide units can, if required, contain from 1 to 80, preferably from 5 to 30, % by weight of further monomers as co-polymerised units. Such monomers are, for example, monoethylenically unsaturated carboxylic acids of 3 to 8 carbon atoms, such as acrylic acid, methacrylic acid, dimethacrylic acid, ethacrylic acid, maleic acid, citraconic acid, methylenemalonic acid, allylacetic acid, vinylacetic acid, crotonic acid, fumaric acid, mesaconic acid and itaconic acid. From this group of monomers, acrylic acid, methacrylic acid, maleic acid or mixtures of said carboxylic acids preferably used. The monoethylenically unsaturated carboxylic acids are used either in the form of a free acids or in the form of their free alkali metal, alkaline earth metals or ammonium salts in the copolymerisation. For neutralisation of the free carboxylic acids, sodium hydroxide solution, potassium hydroxide solution, sodium carbonate, potassium carbonate, sodium bicarbonate, magnesium oxide, calcium hydroxide, calcium oxide, gaseous or aqueous ammonia, triethylamine, ethanolamine, diethanolamine, triethanolamine, morpholine, diethylene triamine, tetraethylenepentamine is preferably used.

Further suitable monomers are, for example, the esters, amides and nitriles of the aforementioned carboxylic acids, e.g. methyl acrylate, ethyl acrylate, methyl methacrylate, ethyl methacrylate, hydroxy ethyl acrylate, hydroxy propyl acrylate, hydroxy butyl acrylate, hydroxy ethyl methacrylate, hydroxy propyl methacrylate, hydroxy butyl methacrylate, hydroxy isobutyl methacrylate, mono methyl maleate, dimethyl maleate, monoethyl maleate, diethyl maleate, 2-ethyl hexyl acrylate, 2-ethyl hexyl methacrylate, acrylamide, methacrylamide, N-dimethyl acrylamide, N-tert butyl acrylamide, acrylonitrile, methacrylonitrile, dimethylamino ethyl acrylate, diethylamino ethyl acrylate, dimethyl amino ethyl methacrylate, diethyl amino ethyl methacrylate, and the salts of the last mentioned basic monomers with carboxylic acids or mineral acids and the quaternised products of the basic (meth) acrylates.

Other suitable copolymerisable monomers are furthermore acrylamido glycolic acid, vinyl sulphonic acid, allyl sulphonic acid, meth allyl sulphonic acid, styrene sulphonic acid, 3-sulphopropyl acrylate, 3-sulphopropyl methacrylate and 2-acrylamido-2-methyl propane sulphonic acid and monomers containing phosphonic acid groups, such as vinyl phosphonic acid, allyl phosphonic acid, and 2-acrylamido-2 methyl propane phosphonic acid. The monomers containing acid groups can be used in the polymerisation in the form of free acid groups and in a form partially or completely neutralised with bases.

Further suitable copolymerisable compounds are N-vinylpyrrolidone, N-vinyl caprolactam, N-vinyl imidazole, N-vinyl-2-methyl imidazole, diallyl ammonium chloride, vinyl acetate, vinyl propionate and styrene. It is of course also possible to use mixtures of said monomers. The said monomers when polymerised alone do not give water-soluble polymers, the polymers containing N-vinylformamide units and/or N-vinylacetamide units containing these comonomers as polymerised units only in amounts such that the copolymers are still water-soluble. In contrast to water in oil polymer emulsions, no organic solvents are required for the aqueous dispersions. If you know from the prior art that concentrated solutions of inorganic salts are a conventional medium for the preparation of aqueous dispersions of water-soluble polymers. As a result, the known dispersions have a very high salt load. The aqueous dispersions of water-soluble polymers used in the method of the present invention tend to be virtually salt free by comparison to conventional dispersions of water-soluble polymers.

The aqueous dispersions of water-soluble polymers of N-vinylformamide units and/or N-vinylacetamide units employed in the method of the present invention preferably have a high polymer content and preferably containing polymers having high molar masses in combination with low viscosity. The molar masses of the polymers containing N-vinylformamide units and/or N-vinylacetamide units are, for example, at least 50,000 DALTONS, such as at least 200,000 DALTONS and preferably at the 1 million DALTONS. The molar masses of the polymers may range between 50,000 DALTONS and 10 million DALTONS, for instance 200,000 DALTONS to 8,000,000 DALTONS, preferably 1,000,000 DALTONS to 5,000,000 DALTONS, such as 2,000,000 DALTONS to 3,000,000 DALTONS.

The molar masses of the polymers of N-vinylformamide units and/or N-vinylacetamide units can be characterised with the aid of the K values according to Fikentscher. The K values are up to 300 and preferably in the range from 130 to 180. From light scattering experiments, it follows that a K value of 250 corresponds to an average molar mass of about 7 million dalton.

The K values should be determined according to H. Fikentscher, Cellulose-Chemie, 13 (1932), 58-64 and 71-74, in aqueous solution at 25° C. and that a concentration which depending on the K value range, of from 0.1 to 5% by weight. The viscosity of the dispersion can for instance be measured in each case in a Brookfield viscometer using a no. 4 spindle at 20 rpm and a 20° C.

The polymeric dispersant (B) can contain at least one functional group selected from ether, hydroxyl, carboxyl, sulphone, sulphate ester, amino, imino, tertiary amino and/or quaternary ammonium groups. Examples of such compounds are: carboxymethylcellulose, water-soluble starch and starch derivatives, starch esters, starch xanthates, starch xanthogenates, starch acetates, dextran, polyalkylene glycols, polyvinyl acetate, polyvinyl alcohol, polyvinylpyrrolidone, polyvinyl pyridine, polyethylenimine, polyvinylimidazole, polyvinylsuccinimide and polydiallyl dimethyl ammonium chloride.

It may be possible that the dispersant (B) also can provide certain functional benefits in the formation and stability of the sizing emulsion.

The aqueous dispersions of N-vinylformamide units and/or N-vinylacetamide units contain from 0.02 to 50, preferably 1 to 50, more preferably from 5 to 40, parts by weight, based on 100 parts by weight of water, of at least one of the above-mentioned polymeric dispersants (B).

The aqueous dispersions of N-vinylformamide units and/or N-vinylacetamide units may be prepared according to the teaching of US 2006 116448.

By eliminating formyl groups from polymers containing N-vinylformamide units and by eliminating the group $CH_3$—CO— from polymers containing N-vinylacetamide units, polymers containing vinyl amine units are formed into each case. Elimination may be effected partially or completely. If the hydrolysis is carried out in the presence of acids, the vinyl amine units of the polymers are present as ammonium salts. The hydrolysis can also be carried out with the aid of bases, or example of metal hydroxides, in particular of alkali metal and alkaline earth metal case hydroxides. Preferably, sodium hydroxide or potassium hydroxide is used. In particular cases, hydrolysis can also be carried out with the aid of ammonia or amines. In the case of the hydrolysis in the presence of bases, the vinyl amine units are present in the form of free bases.

Suitable hydrolysis agents preferably mineral acids, such as hydrogen halides, which may be used in gaseous form or as an aqueous solution. Concentrated hydrochloric acid, sulphuric acid, nitric acid or phosphoric and organic acids, such as $C_1$- to $C_5$-carboxylic acids, and aliphatic or aromatic sulphonic acid are preferably used. For example, from 0.05 to 2, in particular from 1 to 1.5, molar equivalent of acid are required per equivalent of formyl groups in the polymers containing polymerised N-vinylformamide units. Hydrolysis of the N-vinylformamide units takes place significantly more rapidly than that of the polymers having N-vinylacetamide units. If copolymers of the suitable vinylcarboxamides with other comonomers are subjected to the hydrolysis, the comonomer units contained in the copolymer can also be chemically modified. For example, vinyl alcohol units are formed from vinyl acetate units. In hydrolysis, acrylic acid units are formed from methyl acrylate units, and acrylamide or acrylic acid units are formed from acrylonitrile units. The hydrolysis of the N-vinylformamide units and/or N-vinylacetamide units of the polymers (A) can be carried out to an extent from 1 to 100% on a molar basis, for instance 1 to 40%, preferably 5 to 30%, more preferably 5 to 20%, for instance between 10 and 20%.

The water-soluble polymer (A) with or without hydrolysis of N-vinylformamide units and/or N-vinylacetamide units is desirably in the form of particles in the aqueous dispersion. Suitably the particle diameter may between 50 nm and 10 μm, for instance 50 nm to 2 μm, such as 100 to 700 nm. Preferably, the particle diameter is between 1 and 10 μm.

Example 1

Alkenyl Succinic Anhydride (ASA) Emulsification in a Laboratory

Trial 1

A mixture containing Polymin VT (aqueous dispersion polymer containing vinyl formamide units (component A) and containing a polymeric dispersant (component B) supplied by BASF) 37.5 g and water 262 g was stirred using a domestic blender (Osterizer pulse matic 10 manufactured by J Oster Company) set at a low speed (speed level 5) for 1.5 min and then ASA (Kemsize 220, supplied from Sellukem) 50 g was added followed by increasing the speed to the highest speed setting level 9 for 1 min. Finally the speed of the domestic blender was reduced to level 3 and then water was added to bring the mixture up to a volume of 1000 ml.

Trial 2

Trial 1 was repeated except using the following components:

| | |
|---|---|
| ASA (Kemsize 220) | 50 g |
| Polymin VT | 20 g |
| Water | 280 g |

Trial 3

Trial 1 was repeated except using the following components:

| | |
|---|---|
| ASA (Kemsize 220) | 50 g |
| Polymin VT | 5 g |
| Water | 295 g |

Trial 4

Trial 2 was repeated except using the following components:

| | |
|---|---|
| ASA (Kemsize 220) | 50 g |
| Polymin VZ | 20 g |
| Water | 280 g |

Stability of the emulsions produced in the trials are shown in Table 1

TABLE 1

Particle size distribution in microns over time (Malvern Mastersizer)

| | Immediately | | After about 30 min | |
|---|---|---|---|---|
| | % distribution | | | |
| Trial No | <50% | <90% | <50% | <90% |
| 1 | 0.809 | 1.834 | 0.805 | 1.942 |
| 2 | 2.116 | 3.892 | 2.122 | 4.056 |

TABLE 1-continued

| Particle size distribution in microns over time (Malvern Mastersizer) | | | | |
|---|---|---|---|---|
| | Immediately | | After about 30 min | |
| | % distribution | | | |
| Trial No | <50% | <90% | <50% | <90% |
| 3 | not stable | not stable | not stable | not stable |
| 4 | 2.446 | 5.351 | 2.579 | 5.257 |

The results show that good stability is maintained over the period of 30 min.

Example 2

Aqueous emulsions of ASA (Kemsize 220) were prepared using a competitor cationic polymer, a liquid cationic starch with a DS of 0.035, or either of Polymin VT (according to the invention) or Polymin VZ (according to the invention) in an analogous method to Example 1.

TABLE 2

| Cationic Polymer Employed | Ratio of ASA:Polymer |
|---|---|
| Competitor polymer | 1:1.5 |
| Polymin VT | 1:0.75 |
| Polymin VT | 1:0.4 |
| Polymin VZ | 1:0.75 |
| Polymin VZ | 1:0.4 |

Paper hand sheets were prepared in three separate data runs from a commercial papermaking stock employing each of the ASA emulsions as the sizing agent. The Cobb 60 values were measured and the results are shown in the FIGURE. For information sizing results improve with decreasing Cobb 60 value.

It can be seen that on the whole the Cobb 60 values comparable for the Polymin VT and Polymin VZ as the cationic polymer to the Cobb 60 values of the competitor products which is used as at least twice the dose of the products of the invention.

Example 3

A series of ASA emulsions were made using different ratios of ASA (Kemsize 220) and either Polymin VT or Polymin VZ by an analogous method to Example 1 as indicated in Table 3.

TABLE 3

| Emulsion No | Ratio of ASA:Polymin | Dispersion polymer employed |
|---|---|---|
| 1 | 1:0.75 | Polymin VT |
| 2 | 1:0.5 | Polymin VT |
| 3 | 1:0.3 | Polymin VT |
| 4 | 1:0.75 | Polymin VZ |
| 5 | 1:0.5 | Polymin VZ |
| 6 | 1:0.3 | Polymin VZ |

Paper hand sheets of 80 g/m$^2$ were prepared from a cellulosic papermaking stock (B19 Furnish) employing a retention agent each of the emulsions as sizing agents immediately on preparation of the emulsion and then 60 min of the preparing the emulsions. The retention agent was Percol 8385 X and Polymin VT Polymix at a concentration of 0.22% and at a dose of 1.05 kg/tonnes. The hand sheets were produced an a hand sheet former (Rapid-Köthen). Cobb 60 values were measured for each paper hand sheet prepared. The results are shown in Tables 4 and 5.

TABLE 4

| Using emulsions immediately after preparation | | | | | | | | |
|---|---|---|---|---|---|---|---|---|
| Emulsion | dosage amount ASA l/h | dosage amount Polymin | dosage amount water | Polymer conc. in % | Coulter LS 230 D 50 [μm) | Coulter LS 230 D 90 [μm) | Cobb 60 (app. 6-7% moisture) | Cobb 60 dry |
| 1 | 117 | 88.35 | 1182 | 7.5 | | | 33 | 23 |
| 2 | 117 | 58.9 | 1222 | 4.8 | 1.795 | 27.47 | 36 | 29 |
| 3 | 117 | 35.34 | 1253 | 2.8 | 2.584 | 33.3 | 38 | 21 |
| 4 | 117 | 88.35 | 1182 | 7.5 | 1.517 | 3.352 | 23 | 23 |
| 5 | 117 | 58.9 | 1222 | 4.8 | 2.317 | 22.19 | 21 | 18 |
| 6 | 117 | 35.34 | 1253 | 2.8 | 2.788 | 30.16 | 19 | 27 |

TABLE 5

| Using emulsions one hour after preparation | | | | | | | | |
|---|---|---|---|---|---|---|---|---|
| Emulsion | dosage amount ASA l/h | dosage amount Polymin | dosage amount water | Polymer conc. in % | Coulter LS 230 D 50 [μm) | Coulter LS 230 D 90 [μm) | Cobb 60 (app. 6-7% moisture) | Cobb 60 dry |
| 1 | 117 | 88.35 | 1182 | 7.5 | 1.257 | 2.115 | 33 | 23 |
| 2 | 117 | 58.9 | 1222 | 4.8 | 1.404 | 11.92 | 33 | 21 |
| 3 | 117 | 35.34 | 1253 | 2.8 | 2.291 | 22.35 | 41 | 36 |
| 4 | 117 | 88.35 | 1182 | 7.5 | 1.478 | 3.837 | 24 | 26 |
| 5 | 117 | 58.9 | 1222 | 4.8 | 1.617 | 3.959 | 30 | 27 |
| 6 | 117 | 35.34 | 1253 | 2.8 | 1.999 | 6.101 | 21 | 22 |

For determining the degree of sizing of the surface-sized papers, the $Cobb_{60}$ value according to DIN EN 20 535 was determined. The water absorbing of the paper sheet in $g/m^2$ after contact with water and a contact time of 60 s is defined as the $Cobb_{60}$ value. The lower the $Cobb_{60}$ value, the better is the sizing effect of the dispersion used.

It is evident from the results that excellent Cobb 60 values are obtained from the emulsions with no significant loss of effect even after one hour.

The invention claimed is:

1. A method of preparing an aqueous emulsion of a sizing agent for use in a papermaking process comprising, emulsifying the sizing agent for use in a papermaking process into an aqueous liquid, in which an aqueous dispersion of a water-soluble polymer of N-vinylformamide and/or N-vinylacetamide units is added to either the sizing agent or the aqueous liquid before, during or after emulsification, wherein the dispersion contains, based on 100 parts by weight of water, (A) from 0.1 to 80 parts by weight of the water-soluble polymer containing N-vinylformamide units and/or N-vinylacetamide units, and (B) from 0.02 to 50 parts by weight of at least one polymeric dispersant for the water-soluble polymer (A) selected from the group consisting of polyvinylpyrrolidone, polyvinylpyridine, polyvinylimidazole, polyethyleneimine, and polydiallyl dimethyl ammonium chloride, wherein the N-vinylformamide units and/or N-vinylacetamide units of polymer (A) are hydrolyzed to an extent of 1 to 40 mol %.

2. The method according to claim 1, wherein the sizing agent is alkenyl succinic anhydride (ASA).

3. The method according to claim 1, wherein the dispersion contains, based on 100 parts by weight of water, (A) from 5 to 80 parts by weight of the water-soluble polymer containing N-vinylformamide units and/or N-vinylacetamide units and (B) from 1 to 50 parts by weight of the at least one polymeric dispersant.

4. The method according to claim 3, wherein the dispersion contains, based on 100 parts by weight of water, (A) from 10 to 50 parts by weight of the water-soluble polymer containing N-vinylformamide units and/or N-vinylacetamide units and (B) from 5 to 40 parts by weight of the at least one polymeric dispersant.

5. The method according to claim 1, wherein the dispersion contains as component (A) a homopolymer of N-vinylformamide.

6. The method according to claim 1 wherein 5 to 30 mol % of the N-vinylformamide units and/or vinylacetamide units of the polymer (A) have been converted into vinyl amine units by hydrolysis.

7. The method according to claim 1 wherein the polymer (A) has a K value of 130 to 300.

8. An aqueous emulsion of a sizing agent obtained by the method of claim 1.

* * * * *